US005865261A

United States Patent [19]

Cooper et al.

[11] Patent Number: 5,865,261

[45] Date of Patent: Feb. 2, 1999

[54] BALANCED OR UNDERBALANCED DRILLING METHOD AND APPARATUS

[75] Inventors: Gary E. Cooper, Aberdeen, United Kingdom; Alex Crabtree, Calgary, Canada; David Cameron, Aberdeen, United Kingdom

[73] Assignee: Baker Hughes Incorporated, Houston, Tex.

[21] Appl. No.: 796,652

[22] Filed: Mar. 3, 1997

[51] Int. Cl.[6] ..... F21B 7/18

[52] U.S. Cl. ..... 175/71; 175/205

[58] Field of Search ..... 175/57, 65, 71, 175/205

[56] References Cited

U.S. PATENT DOCUMENTS

| | | | |
|---|---|---|---|
| 1,324,304 | 12/1919 | Carmichael | 175/205 |
| 1,479,064 | 1/1924 | Gracey . | |
| 2,855,952 | 10/1958 | Tausch et al. . | |
| 3,244,234 | 4/1966 | Flickinger . | |
| 3,381,756 | 5/1968 | Regan . | |
| 3,398,760 | 8/1968 | Fox et al. . | |
| 3,407,830 | 10/1968 | Regan . | |
| 3,583,481 | 6/1971 | Vernotzy . | |
| 3,958,639 | 5/1976 | Daniel | 175/57 |
| 4,257,484 | 3/1981 | Whitley et al. . | |
| 4,398,555 | 8/1983 | Taylor . | |
| 4,602,684 | 7/1986 | Van Wormer et al. . | |
| 4,681,372 | 7/1987 | McClure | 299/8 |
| 5,249,635 | 10/1993 | King et al. | 175/48 |
| 5,407,020 | 4/1995 | Beavers | 175/71 |
| 5,411,105 | 5/1995 | Gray | 175/69 |
| 5,531,507 | 7/1996 | Jackson | 299/13 |

FOREIGN PATENT DOCUMENTS

| | | | |
|---|---|---|---|
| 861581 | 9/1981 | U.S.S.R. | 175/205 |

*Primary Examiner*—William Neuder
*Attorney, Agent, or Firm*—Rosenblatt & Redano P.C.

[57] ABSTRACT

A casing or tubing segment or segments are disclosed which can be used to create a parasite annulus during drilling. The cased wellbore receives a string containing valves and the drillstring operates through it. As the mud circulates, the segments of the tubing or casing provide communication at various depths from the parasite annulus (i.e., the outermost annulus) into the circulating mud, which is the innermost annulus. Each valve is adjustable to alter the amount of differential pressure required in order to open it. The valves are also in hydraulic pressure balance so that only the pressure added by the injected gas acts to open them. The valves close by a spring bias.

16 Claims, 1 Drawing Sheet

BALANCED OR UNDERBALANCED DRILLING METHOD AND APPARATUS

FIELD OF THE INVENTION

The field of this invention relates to drilling, particularly drilling in a balanced or underbalanced condition.

BACKGROUND OF THE INVENTION

Drilling mud is circulated in the borehole through the drill bit to facilitate the drilling process. The circulating mud takes away the cuttings formed by the drill bit and brings them to the surface, where they are separated from the drilling fluid and the drilling fluid is recycled. As the well is drilled deeper, the column of mud acting on the formation at the bottom of the wellbore grows longer, thereby exerting a greater pressure on the formation. In certain formations, the presence of pressure on the pay zone, even during drilling, can adversely affect the ultimate performance of the well when it is brought in, due to formation damage caused by the drilling medium invading virgin formation.

In the past, the techniques that have been employed to address this problem have involved an insertion of a tubular with gas injection behind the tubular in an annular space at the periphery of the wellbore. The gas is inserted at the surface and must pass to the bottom of the tubular in order to come up and around inside the tubular back to the surface. Thus, attempts to lighten the pressure exerted on the formation by the column of mud in the wellbore being drilled have been limited due to the inability to inject gas at any other point except close to the bottom of the wellbore. The density of the circulating mud changes during the drilling operation and, thus, the ability to only inject gas very near the drill bit at times does not permit proper control to maintain the balanced or underbalanced condition. Underbalanced drilling has been attempted using nitrified drilling fluid or other light drilling fluids. However, these techniques had problems.

Various designs of tubing valves used downhole are illustrated in U.S. Pat. Nos. 3,583,481; 4,602,684; 4,257,484; 3,407,830; and 3,398,760.

Accordingly, one of the objectives of the present invention is to provide access from a parasite annulus along the length of the annulus so that injection can occur at various depths. Another objective is to provide adjustability for each of the communication valves through from the parasite annulus to allow more control of the distribution of gas from the parasite annulus into the mud column for better controlled drilling conditions.

SUMMARY OF THE INVENTION

A casing or tubing segment or segments are disclosed which can be used to create a parasite annulus during drilling. The cased wellbore receives a string containing valves and the drillstring operates through it. As the mud circulates, the segments of the tubing or casing provide communication at various depths from the parasite annulus (i.e., the outermost annulus) into the circulating mud, which is the innermost annulus. Each valve is adjustable to alter the amount of differential pressure required in order to open it. The valves are also in hydraulic pressure balance so that only the pressure added by the injected gas acts to open them. The valves close by a spring bias.

DETAILED DESCRIPTION OF THE PREFERRED EMBODIMENT

Figure 1:
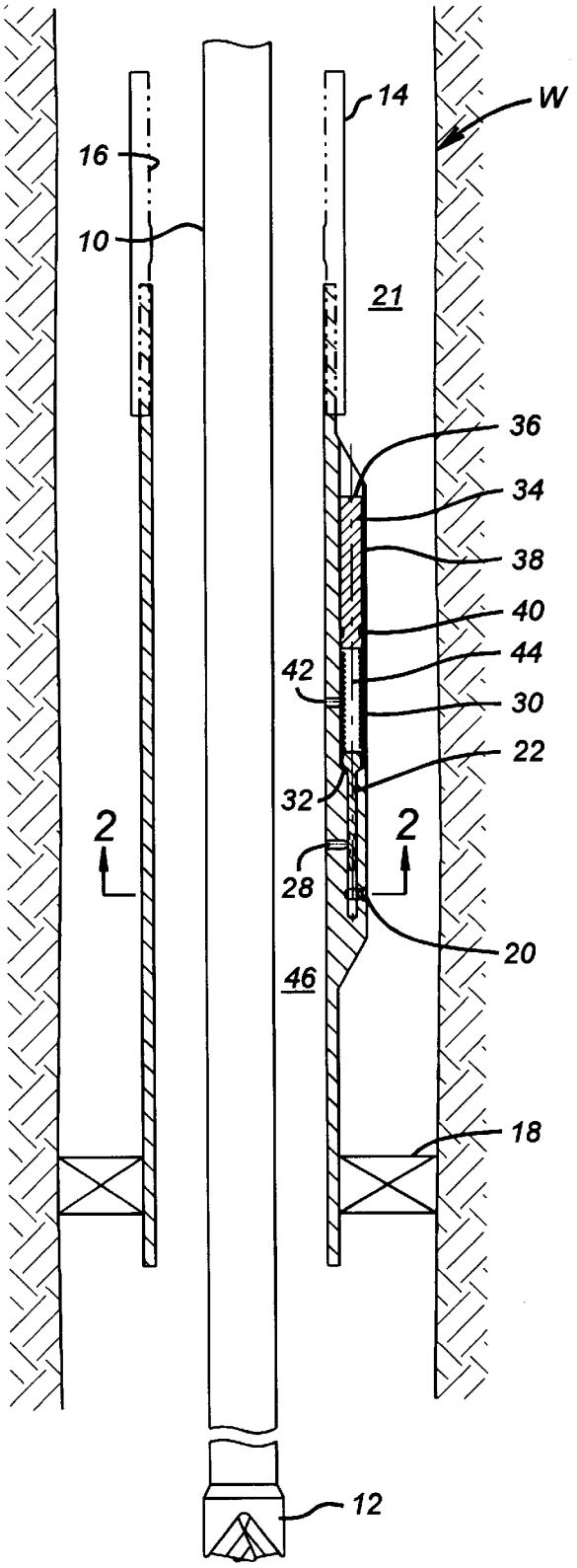
FIG. 1 is a sectional elevational view showing one of many segments of a casing or tubing string which forms the parasite annulus and the valve mechanism therein.

FIG. 1 illustrates in section a cased wellbore W which is being further drilled. The drillstring 10 is connected to a bit 12, shown schematically. Inserted in the wellbore W is the parasite casing or tubing string 14, a portion of which is shown in the wellbore W of FIG. 1. The valve assembly, as illustrated, can appear in different segments as a portion of the parasite string 14. This is illustrated by providing a thread 16 to allow identical sections of the string 14 to be installed at various depths in the wellbore W. Toward the lower-most end, which is illustrated in FIG. 1, a packer 18 seals off the parasite or outer annulus 21. Gas injection occurs from the surface into the parasite annulus 21. The gas is prevented from passing by packer 18 and, therefore, acts on opening 20, which provides access to needle 22. Needle 22 has seals points 24 and 26 which in the position shown in FIG. 1 straddle outlet 28. Spring 30 biases needle 22 to the position shown in FIG. 1 where shoulder 32 acts as a travel stop for needle 22. The amount of preload on spring 30 is adjusted by turning adjusting screw 34, which has a hex head 36 and is retained by threads 38 to the string 14. Seal 40 seals the threaded connection at 38. An equalizing port 42 communicates with cavity 44 to allow the pressure in inner annulus 46 to enter the cavity 44. With opening 20 providing access to parasite annulus 21 and the pressure in inner annulus 46 communicating with cavity 44 through opening 42, the needle 22 is close to hydraulic balance with spring 30 keeping the needle 22 seated against its travel stop 32. When, during drilling, a balanced or underbalanced condition is desired, gas is injected from the surface into the parasite annulus 21. The adjusting screws 34 can be preadjusted at the surface so as to provide a greater preload for the assemblies nearer the surface than those further down to discourage short circuiting of the gas in the parasite annulus 21 into the upper portions of the annulus 46. Alternatively, the adjusting screws 34 can be set to favor initial flow from annulus 21 into annulus 46 closer to the surface with additional flow further downhole as a result of additional pressure applied to annulus 21.

Figure 2:
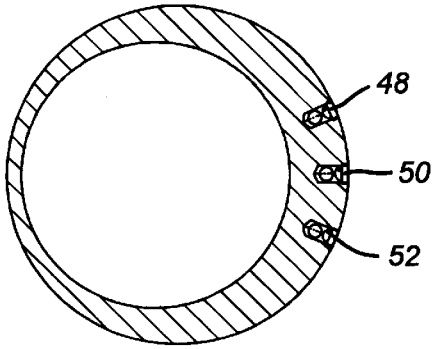
FIG. 2 is the view along lines 2—2 of FIG. 1.

FIG. 2 indicates that each segment of the string 14 has the valve assemblies, as described, in an eccentric manner. Each valve assembly 48, 50, and 52 are offset from each other, preferably about 22°, and are eccentric to the center line of the parasite string 14. Among a given group of valve assemblies 48, 50, and 52, the setting for preload can be different so that as pressure is increased in annulus 21, additional valves at the same elevation will open.

Those skilled in the art can appreciate that the string 14 can be lengthened as the drilling progresses by a sequential release of the packer 18 and addition of further components from the surface so that the string 14 comes close to the position of the bit 12. As the drilling progresses, the string 14 is lengthened after a predetermined amount of drilling has occurred. The string 14 does not have to reach as far down as the bit. The degree of underbalance, as well as well conditions, will determine the length of string 14 during drilling.

Using known techniques to compute the amount of decrease in density of the mud column, the layout, as illustrated above, can be used to facilitate injection of gas throughout the string to facilitate the drilling operation. The same valve assembly, such as 48, 50, and 52, disposed at different heights could also subsequently be used in a production string as a gas-lift technique to stimulate the well to flow to the surface in low-pressure formations. The advantage of the present invention can be readily seen during drilling where injection at preselected points can be determined, allowing better feedback at the surface of the effects of the gas injection through the various portions of the string 14. With better control during the drilling operation, less damage is done to the formation during drilling, which enhances the possibilities of better production when the well is put in service. Through the use of the parasite string 14, better control of mud density is accomplished, which reduces the possibility of formation damage and is more dependable than prior techniques of control of mud density, because the feedback obtained with gas injection as to pressure exerted on the formation is much faster than known alternatives.

The foregoing disclosure and description of the invention are illustrative and explanatory thereof, and various changes in the size, shape and materials, as well as in the details of the illustrated construction, may be made without departing from the spirit of the invention.

We claim:

1. A method of drilling a cased wellbore deeper, comprising:

running in a first string to define an outer annulus with the cased wellbore;

sealing said outer annulus between said first string and the cased wellbore;

running in a bit on a drillstring through said first string to define an inner annulus between said drillstring and said first string;

circulating drilling fluids through the bit and out of the wellbore through said inner annulus;

injecting gas into said inner annulus from said outer annulus into drilling fluids flowing up said inner annulus to the surface; and reducing the density of the circulating drilling fluids by said injection of gas.

2. The method of claim 1, further comprising:

using at least one injection valve mounted to said first string to selectively allow gas to pass from said outer annulus to said inner annulus.

3. The method of claim 2, further comprising:

using a plurality of valves at different depths along said first string.

4. The method of claim 2, further comprising:

providing a plurality of valves at a given depth on said first string.

5. The method of claim 3, wherein:

said valves are configured to open at different depths as the pressure in said outer annulus is increased.

6. The method of claim 3, wherein:

said valves are configured to open at different depths at substantially a predetermined pressure in said outer annulus.

7. The method of claim 2, further comprising:

pressure-balancing said valve as between said outer and inner annulus by exposing opposed surfaces on said valve to said outer and inner annulus.

8. The method of claim 7, further comprising:

applying a biasing force to hold said valve closed until a predetermined differential pressure across said valve is reached.

9. The method of claim 8, further comprising:

adjusting the amount of preload biasing force on said valve so that it doesn't open until a predetermined force is applied.

10. The method of claim 9, further comprising:

using a plurality of valves at different depths along said first string.

11. The method of claim 9, further comprising:

providing a plurality of valves at a given depth on said first string.

12. The method of claim 10, wherein:

said valves are configured to open at different depths as the pressure in said outer annulus is increased.

13. The method of claim 10, wherein:

said valves are configured to open at different depths at substantially a predetermined pressure in said outer annulus.

14. The method of claim 1, further comprising:

increasing the length of said first string as the drilling progresses.

15. The method of claim 1, further comprising:

creating an underbalanced condition at the drill bit due to said injecting.

16. The method of claim 1, further comprising:

creating a balanced condition at the drill bit due to said injecting.

* * * * *